US008414257B2

(12) United States Patent
Scott et al.

(10) Patent No.: US 8,414,257 B2
(45) Date of Patent: Apr. 9, 2013

(54) SELF-PRIMING CENTRIFUGAL PUMP

(75) Inventors: Thomas Scott, Lucas, OH (US); Michael Keith, Mansfield, OH (US); Donald Racer, Shelby, OH (US)

(73) Assignee: The Gorman-Rupp Co., Mansfield, OH (US)

( * ) Notice: Subject to any disclaimer, the term of this patent is extended or adjusted under 35 U.S.C. 154(b) by 1379 days.

(21) Appl. No.: 11/580,281

(22) Filed: Oct. 13, 2006

(65) Prior Publication Data

US 2008/0076619 A1 Mar. 27, 2008

Related U.S. Application Data

(60) Provisional application No. 60/846,093, filed on Sep. 21, 2006.

(51) Int. Cl.
*F04B 39/06* (2006.01)

(52) U.S. Cl. ..... 415/204; 415/203; 417/204; 417/900

(58) Field of Classification Search ..... 417/204, 417/312, 423.1, 423.14, 900; 415/203, 206
See application file for complete search history.

(56) References Cited

U.S. PATENT DOCUMENTS

| | | | |
|---|---|---|---|
| 3,778,181 | A | 12/1973 | McFarlin |
| 4,052,133 | A | 10/1977 | Yeater |
| 6,887,034 | B2 | 5/2005 | Mesiter et al. |
| 2005/0095124 | A1 | 5/2005 | Arnold et al. |

OTHER PUBLICATIONS

International Search Report and Written Opinion of the International Searching Authority, issued in International Application No. PCT/US06/40369, dated on Dec. 6, 2007.
Goulds Trash Hog® Self-Priming Solids Handling Pumps, 2008, Goulds Pumps, Incorporated, ITT Corporation.
Product Catalog, Ace 150 Series High Performance Pumps FMC-150SP-HYD-206, Revised May 2006.
Product Catalog, Ace Pumps, Ace Pump Corporation, Memphis TN USA, 2005.

*Primary Examiner* — Charles Freay
*Assistant Examiner* — Patrick Hamo
(74) *Attorney, Agent, or Firm* — McDermott Will & Emery LLP

(57) ABSTRACT

An improved self-priming, centrifugal pump arrangement for mixed-media flow includes a volute housing having a suction and a discharge, a volute scroll disposed within the volute housing, an impeller disposed within the volute scroll, a suction hopper and a discharge hopper within volute housing, a back cover and a wear plate attached to the volute housing. By optimizing the geometry of these internal components, noise is reduced, efficiency of the pump is improved, and the self-priming feature is maintained.

19 Claims, 8 Drawing Sheets

SELF-PRIMING CENTRIFUGAL PUMP

CROSS-REFERENCE TO RELATED APPLICATION

This application claims the benefit of U.S. Provisional Application No. 60/846,093, filed Sep. 21, 2006, which is hereby incorporated herein by reference in its entirety.

TECHNICAL FIELD

The technical field relates to pumps, and, more particularly to pumps used to pump mixtures of solids and liquids, solids-laden mixtures, and slurries.

BACKGROUND

Centrifugal pumps use centrifugal force to move liquids from a lower pressure to a higher pressure and employ an impeller, typically comprising of a connecting hub with a number of vanes and shrouds, rotating in a volute or casing. Liquid drawn into the center of the impeller is accelerated outwardly by the rotating impeller vanes toward the periphery of the casing, where it is then discharged at a higher pressure.

Centrifugal pumps, such as trash pumps, are conventionally used in applications involving mixtures of solids and liquids, solids-laden mixtures, slurries, sludge, raw unscreened sewage, miscellaneous liquids and contaminated trashy fluids, collectively referred to as mixed-media flow or mixed-media fluids. These mixed-media fluids are encountered in applications including, but not limited to, sewage plants, sewage handling applications, paper mills, reduction plants, steel mills, food processing plants, automotive factories, tanneries, and wineries.

As one example, such pumps are used in sewage lift stations to move wastewater to a wastewater treatment plant. In some aspects, submersible pumps are disposed in a wet well below ground (e.g., 20' below ground) and are configured to lift the wastewater to an elevation just below ground level, where it is passed to downwardly sloping conduits that utilize gravity to move the flow along the conduit to the next lift station. This operation is repeated at subsequent lift stations to move the wastewater to a wastewater treatment plant. Another form of lift station utilizes "dry well" pumps, wherein one or more self-priming centrifugal pumps and associated controls and drivers (i.e., motor or engine) are either located in a (dry) building above ground or in a (dry) fiberglass (or concrete, metal, and/or polymer) room disposed below ground. Above-ground configurations utilize a self-priming centrifugal pump and an intake extending down into a wet well holding the influent wastewater. An exemplary solids-handling self-priming centrifugal pump for such application includes the Gorman Rupp T-Series™ or Super T-Series™ pumps, which feature a large volute design allowing automatic re-priming in a completely open system without the need for suction or discharge check valves and with a partially liquid-filled volute housing and a dry suction line. Depending on the size and configuration, these pumps generally handle a maximum solids diameter of between about 1.5"-3" with a maximum head of between about 110 ft.-150 ft. Below-ground configurations typically use either a non-self-priming centrifugal pump disposed beneath the wet well, so as to provide a flooded pump suction, or use a self-priming pump. Flooded non-self-priming pumps correspondingly require an isolation means (e.g., a valve) to permit isolation of the pump suction to allow for pump cleaning and maintenance.

The nature of the conveyed medium poses significant challenges to continuous operation of the pumps. One potential problem in such applications is the clogging of the impeller or pump by debris in the pumped medium. Therefore, pump serviceability is an important factor. Conventional multi-stage pumps comprise a plurality of stages sequentially arranged so that the discharge portion of one stage feeds liquid into the suction portion of the next stage and each impeller is driven by a common impeller drive shaft. Rotation of the impeller drive shaft turns each impeller to force fluid outwardly into an internal passage which directs the fluid to the subsequent adjacent pump stage. However, these internal passages are difficult to clean and the pump must be substantially dismantled to permit cleaning. Predictably, these multi-stage pumps are used in applications where fouling or clogging is not of concern, such as well or water pumps, and these pumps are not conducive to use in mixed-media flow.

Additional improvements in pump characteristics, such as discharge head, would be advantageous in many applications. For example, in the above-noted sewage handling application, lift stations are expensive to build, with a cost that typically ranges between about forty five thousand dollars and several hundred thousand dollars and may even exceed a million dollars in some instances. A higher head, solids-handling, self-priming, centrifugal pump could be used to reduce the number of lift stations required to transmit wastewater to a wastewater treatment facility. Use of larger, higher-head trash pumps is possible, but such large pumps would have to operate at speeds higher than is generally advisable for a trash-type impeller, particularly in view of the fact that sewage pumps are expected to provide efficient operation for long periods of time without the need for frequent maintenance. Addition of pumps in series with existing pumps in a conventional manner is cumbersome or highly impractical given the space constraints imposed by the limited space available in conventional lift stations, and would be a costly proposition when the additional space requirements are factored into the designs of new, more expansive facilities.

SUMMARY

Accordingly, there is a need for an improved self-priming, centrifugal-pump configuration for pumping mixtures of solids and liquids, solids-laden mixtures, and slurries. There is also a need for an improved pump configuration providing increases in pump performance and reducing noise while simultaneously maintaining a compact configuration (e.g., without increasing the footprint of the pump). To fulfill these needs the geometry of certain pump components is altered in the present invention to optimize the overall performance of the pump.

In one aspect, a pump arrangement for mixed-media flow includes a self-priming, centrifugal pump with a volute housing having a suction and a discharge, and a volute scroll disposed within the volute housing, and a rotating assembly comprising an impeller shaft and impeller. The ratio of the volute scroll throat area to the impeller relative exit area ("REA") is increased (as compared with conventional self-priming pumps) to reduce noise and improve pump efficiency while maintaining the self-priming capability.

In another aspect, a pump arrangement is provided comprising a self-priming, centrifugal pump having a volute housing with a suction and a discharge and volute scroll disposed within the volute housing. The volute scroll throat area is increased above that of a conventional self-priming pump, resulting in reduced noise and movement of the Best Efficiency Point ("BEP") while still maintaining the self-priming feature of the pump. The movement of the BEP results in an expanded optimum range of operation.

In yet another aspect, a pump arrangement is provided comprising a self-priming, centrifugal pump having a volute housing with a suction and a discharge, and a volute scroll surrounded by the volute housing. In this embodiment, the volume of the volute scroll is increased over that of a conventional self-priming pump. The result is reduced noise. Similarly, the width of the volute scroll may be increased without increasing the impeller REA, achieving like results.

In yet another aspect of the present invention, a self-priming, centrifugal pump comprises a volute housing having a suction and a discharge, and a volute scroll disposed within the volute housing. The volute scroll includes a cutwater member that serves as a leading edge for water flowing through the volute scroll. The invention also comprises a rotating assembly having an impeller shaft and impeller. The distance between the cutwater member and the outer diameter of the impeller is larger than that of a conventional self-priming pump, resulting in reduced noise and improved pump efficiency.

In yet another aspect of the present invention, a self-priming, centrifugal pump comprises a volute housing having a suction and a discharge, a volute scroll disposed within the volute housing, a suction hopper and discharge hopper. The ratio between the volume of suction hopper and the volume of discharge hopper is larger than that of a conventional, self-priming pump, resulting in improved self-priming.

Another aspect of the present invention provides a self-priming, centrifugal pump comprising: a volute housing having a suction and discharge, the suction having a suction hopper connected thereto and the discharge having a discharge hopper connected thereto; a volute scroll having a cutwater member and a volute scroll throat area, the volute scroll being disposed within the volute housing; an impeller disposed within the volute scroll, the impeller having a relative exit area and an outer diameter; and, a back cover and wear plate assembly.

A ratio of the volute scroll throat area to the impeller relative exit area is at least about 0.54. A ratio of the volute scroll throat area to the cross-sectional area of the discharge is no greater than about 1.34. A ratio of the volume of the volute scroll to the cross-sectional area of the discharge is no greater than about 73.60. A ratio of the diameter of the cutwater to the outer diameter of the impeller is at least about 1.01. A ratio of the volume of the suction hopper to the volume of the discharge hopper is no greater than about 1.89. A cross-sectional area of the suction is greater than the cross-sectional area of the discharge.

The wear plate has inner and outer circumferences and notches disposed on the inner circumference of the wear plate. The back cover is connected to the wear plate, the back cover having inner and outer circumferences and grooves disposed on the inner circumference of the back cover, the position of the grooves on the back cover corresponding to the position of the notches on the wear plate. There is at least one first support post connecting the back cover to the wear plate and at least one second support post connecting the back cover to the wear plate. The at least one first and second support posts are disposed such that flow through the volute scroll is not impeded.

In yet another aspect of the present invention, a self-priming, centrifugal pump comprises a suction and a discharge. Typically, the suction and discharge of conventional self-priming pumps are the same size. However, the present invention includes a suction that is larger than that of the discharge, thus resulting in reduced pump noise and increased NPSHa.

In yet another aspect of the present invention, a self-priming, centrifugal pump comprises a back cover having support posts which maintain the face clearance between the wear plate and the face of the impeller. The support posts of the back cover are relocated to avoid the flow path of solid-laden liquid that flows through the pump and causes clogging. Furthermore, notches and divots are added, to enhance the self-cleaning feature of the invention.

Additional advantages of the present invention will become readily apparent to those skilled in this art from the following detailed description, wherein only an exemplary embodiment of the present invention is shown and described, simply by way of illustration of the best mode contemplated for carrying out the present invention. As will be realized, the present invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION

On one hand, altering the geometry of certain internal components of a pump increases pump efficiency and reduces noise, but negatively affects the self-priming capability. On the other hand, altering the geometry of other internal components of a pump improves the self-priming capability but degrades overall pump performance and increases noise. The present invention combines these changes to the internal components of a pump. As a result, the advantages of the two types of modifications are combined, resulting in a self-priming, centrifugal pump having improved efficiency and reduced noise in which the self-priming capability is maintained.

Altering the geometry of the inventive pump result in drastic improvements to overall performance. For example, modifications to the inventive 6" pump resulted in a 10% increase in efficiency and a 4.9 DbA reduction in the noise level over a conventional pump at the same speeds (see Table 1). The inventive 6" pump even showed improvements at a speed higher than that of a conventional pump, as shown in Table 1. At the same time, the self-priming capability is maintained as shown by the increase in lift of 1-2 ft., depending on the speed of the pump (see Table 2). Similar improvements can be shown for the inventive 3" and 4" pumps.

Figure 1:
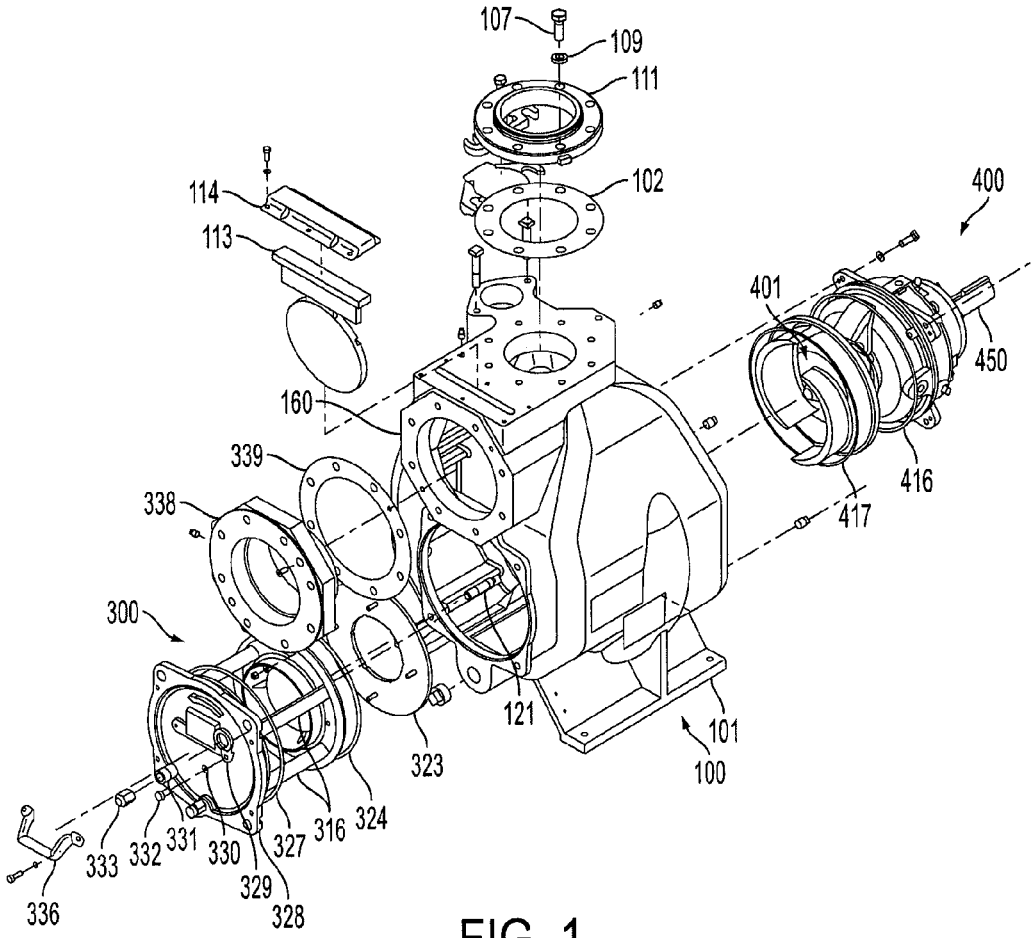
FIG. 1 is an isometric, exploded view of a self-priming, centrifugal pump of an embodiment of the present invention.

Referring now to FIG. 1, shown is an isometric, exploded view of the pump of the present invention. Certain features from the Gorman-Rupp Company Super T-series™ of self-priming centrifugal pumps are present in the pump of FIG. 1. For example, rotating assemblies 400 are, in the illustrated example, manufactured by the Gorman-Rupp Company of Mansfield, Ohio. The impeller 401 and the wear plate 323 each comprise any conventional metal, alloy, polymer or composite suitably durable for an intended application and duty life. The impeller 401 and/or the wear plate 323 also include hardened surfaces or added layers of hardened materials facing the opposing one of the impeller or wear plate.

In some aspects of the invention, impeller 401 comprises gray iron, ductile iron, hard iron, CF8M stainless-steel, or CD4MCu. In one aspect, the impeller 401 comprises an impeller such as described in the patent application titled "Improved Impeller and Wear Plate", assigned to the Gorman-Rupp Company, and filed on Oct. 31, 2003 as U.S. patent application Ser. No. 10/697,162, and which is hereby incorporated by reference in its entirety. The rotating assembly 400 is attached to a corresponding surface of the volute housing 101 using one or more mechanical fasteners, such as a plurality of bolts or screws. O-rings 417, 416 are provided to both seal the connection between the rotating assembly 400 and such corresponding surface of the centrifugal volute housing 101, as well as to facilitate external clearance adjustments.

The removable back cover and wear plate assembly 300, which is also offered by the Gorman-Rupp Company, is shown to include a back cover 328 having a handle 336, locking collar 329, adjustment screw 331, hand nut 333, and hex head capscrew 332. The removable back cover and wear plate assembly 300 is described in the patent application titled "Centrifugal Pump Having Adjustable Cleanout Assembly", assigned to the Gorman-Rupp Company, and filed on Sep. 16, 2002 as U.S. patent application Ser. No. 10/221,825, and which is hereby incorporated by reference in its entirety. In one aspect, shown in FIG. 1, the removable back cover and wear plate assembly 300 is positioned within the centrifugal pump 100 using one or more studs 121. Back cover 328 is preferably shim-less to permit easy adjustment and eliminate the need to realign belts, couplings, or other drive components without disturbing the working height of the seal assembly or the impeller back clearance. O-rings 327, 324 are respectively provided to seal the back cover 328 against the corresponding surfaces of the volute housing 101 and to seal the connection between the back cover 328 and wear plate 323 against the corresponding surfaces of volute housing 101.

Support posts 316*a-d* are provided to dispose the wear plate 323 at a predetermined location within the volute housing 101. In the illustrated example, the support posts 316*a-d* are ribs and the position of the wear plate 323 may be adjusted by adjusting a position of the back cover 328 relative to volute housing 101. In other aspects, however, support posts 316*a-d* may be adjustable to permit positioning adjustment by variation of an adjustable length of the support posts. Suction flange 338 and suction gasket 339 are connected to volute housing 101 by mechanical fasteners to provide a suction.

Flap valve or check valve 113 is optionally disposed on an inside of the suction and affixed at an upper end to the centrifugal volute housing 101 by flap valve cover 114. Flap valve cover 114 is attached with mechanical fasteners that permit flap valve 113 to be accessed without the need for special tools.

In one aspect of the invention, shown in FIG. 1, discharge flange 111 is disposed over a discharge gasket 102 at an upper side of volute housing 101 and connected thereto by conventional mechanical fasteners such as, but not limited to, hex cap screws 107, and lock washers 109. In this configuration, self-priming centrifugal pump 100 is provided separately from another straight centrifugal pump (not shown) as a stand-alone unit having a discharge connected directly to a discharge piping run. This modularity permits a municipality, facility, or purchaser to purchase a first pump as a stand-alone unit to match existing capacity needs and/or budgets while maintaining the option of adding a second straight centrifugal pump (not shown) at a later time. If modularity is not an issue, the discharge flange 111 and associated components may be eliminated.

Figure 2A:
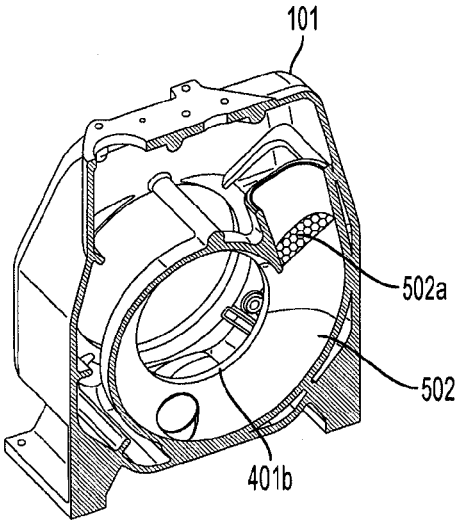
FIG. 2A is a partial perspective view of the volute housing of an embodiment of the present invention.
Figure 2B:
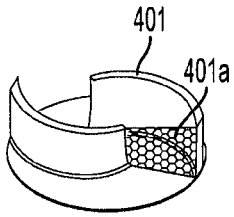
FIG. 2B is a partial perspective view showing the impeller relative exit area of an embodiment of the present invention.

Referring now to FIGS. 2*a* and 2*b*, an embodiment of the present invention is shown including volute housing 101, volute scroll 502 within volute housing 101, volute scroll throat area 502*a*, impeller 401, and impeller relative exit area ("REA") 401*a*. The ratio of surface areas of volute scroll throat area 502*a* to impeller REA 401*a* is increased compared to conventional self-priming pumps. For example, for a conventional 3" self-priming, centrifugal pump:

$$5.39\ \text{in.}^2(\text{volute scroll throat area})/13.39\ \text{in.}^2(\text{impeller } REA)=0.40.$$

In contrast, the inventive 3" pump has the following relevant characteristics and ultimate ratio:

$$8.61\ \text{in.}^2(\text{volute scroll throat area})/14.448\ \text{in.}^2(\text{impeller } REA)=0.60.$$

The range of volute scroll throat area 502*a* includes about 7.75 in.$^2$. The range of impeller REA 401*a* includes about 13.00 in.$^2$ to about 15.89 in.$^2$. Increasing the volute scroll throat area to impeller REA of the 3" pump helps improve efficiency and reduces noise, as shown by the test results below in Table 1. An inventive 6" pump is 10 percentage points more efficient than a conventional pump and 4.9 DbA quieter at the same speeds.

TABLE 1

| Pump | Speed (rpm) | BEP (TDH @ gpm) | Efficiency (%) | Noise (DbA) |
|---|---|---|---|---|
| T6 | 1650 | 96.2 @ 1100 | 61.5 | 83.9 |
| V6 | 1650 | 88.9 @ 1605 | 71.5 | 79.0 |
| V6 | 2000 (max.) | 138.0 @ 1750 | 68.7 | 82.0 |
| T4 | 1950 | 94.1 @ 600 | 54.0 | 84.2 |
| V4 | 1650 | 56.0 @ 800 | 59.2 | 76.4 |
| V4 | 2400 (max.) | 128.7 @ 1000 | 58.3 | 82.0 |
| T3 | 2150 | 91.0 @ 400 | 50.0 | 84.2 |
| V3 | 2250 | 93.50 @ 650 | 57.5 | 77.7 |
| V3 | 2600 (max.) | 136.5 @ 650 | 57.7 | 82.3 |

The testing details are as follows.

For the pumps used, "Tx" denotes a conventional pump such as a Gorman-Rupp T-Series pump, with "x" corresponding to the discharge size. For example, T6 denotes the T-Series 6" pump. "Vx" denotes an inventive pump such as a Gorman-Rupp V-Series pump, with "x" denoting the discharge size.

Similarly, for the conventional, self-priming 4" pump:

$$8.61\ \text{in.}^2(\text{throat area})/21.21\ \text{in.}^2(\text{impeller } REA)=0.41.$$

In contrast, the inventive 4" pump has the following relevant characteristics ultimate ratio:

14.490 in.$^2$(volute scroll throat area)/18.49 in.$^2$(impeller *REA*)=0.78.

The range for volute scroll throat area 502*a* includes about 13.04 in.$^2$ to about 15.94. The range for impeller REA 401*a* includes about 16.64 in.$^2$ to about 20.33 in$^2$.

Similarly, for the conventional, self-priming 6" pump:

13.61 in.$^2$(volute scroll throat area)/19.33 in.$^2$(impeller *REA*)=0.70.

In contrast, the inventive 6" pump has the following relevant characteristics and ultimate ratio:

23.68 in.$^2$(throat area)/23.520 in.$^2$(impeller *REA*)=1.01.

The range for volute scroll throat area 502*a* includes about 21.32 in.$^2$ to about 26.01 in.$^2$. The range for the impeller REA includes about 21.17 in$^2$ to about 25.87 in.$^2$.

Increasing the volute scroll throat area to impeller REA ratio increases pump performance and reduces noise, as shown by test results in Table 1. For example, the conventional 6" self-priming, centrifugal pump is 61.5% efficient and generates 83.9 DbA of noise at a speed of 1650 rpm. In contrast, the 6" pump of this embodiment of the present invention is 71.5% efficient and generates 79.0 DbA of noise at the same speed. In fact, the 6" pump of this embodiment of the present invention is more efficient and quieter at its maximum speed of 2000 rpm than the same 6" version of a conventional self-priming, centrifugal pump operating at a lesser speed.

Ratios of volute scroll throat area to impeller REA include a range of about 0.54 to about 1.11.

Figure 3:
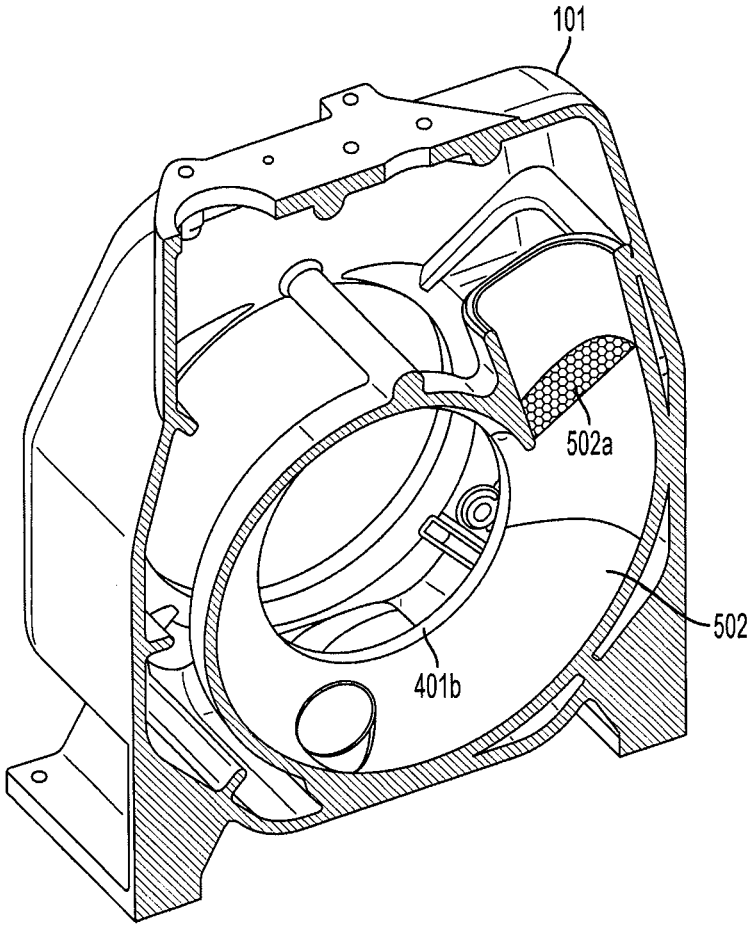
FIG. 3 is a partial perspective view of an embodiment of the present invention.

FIG. 3 illustrates a cut-away depiction of volute housing 101, volute scroll throat area 502*a*, and volute scroll 502. According to the present invention, an increase in the surface area of volute scroll throat area 502*a*, even without increasing impeller REA 401*a*, also contributes to improved performance of a self-priming, centrifugal pump.

Figure 4:
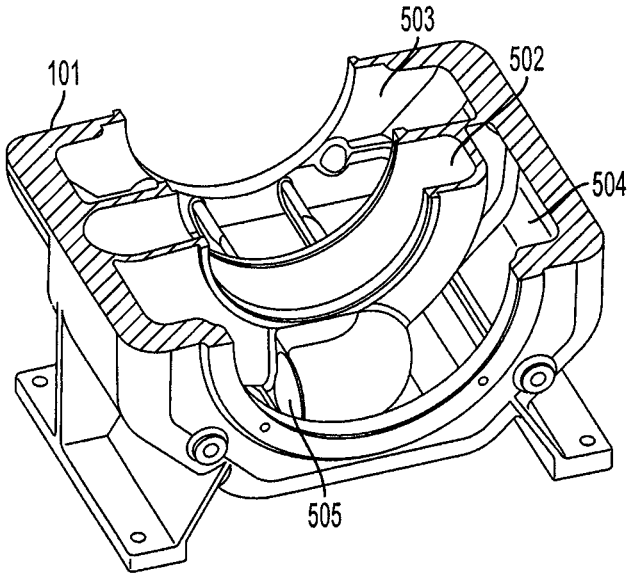
FIG. 4 is a partial perspective view of the lower half of an embodiment of the present invention.

FIG. 4 is a partial, cut-away view of a pump of the present invention, including volute housing 101, volute scroll 502, suction hopper 503, discharge hopper 504, and mole hole priming port 505. Increasing the volume of volute scroll 502 improves performance over a conventional self-priming pump. For example, the volume of volute scroll 502 for a conventional 3" self-priming pump is about 261.73 in.$^3$. For the present invention, however, the volume of volute scroll 502 is a range of about 391.69 in.$^3$ to about 478.33 in.$^3$ or 435.01 in.$^3$, or 1.66 times scroll 502 of a conventional self-priming pump. Similarly, the volume of volute scroll 502 for a conventional 4" self-priming pump is about 373.64 in.$^3$. For a 4" pump embodiment of the present invention, however, the volume of volute scroll 502 is a range of about 572.19 in.$^3$ to about 700.34, such as about 637.17 in.$^3$, 1.705 times volute scroll 502 of a conventional self-priming pump. Likewise, the volume of volute scroll 502 for a typical 6" self-priming pump is about 602.87 in.$^3$. In contrast, the enlarged volume of volute scroll 502 of an inventive pump is a range of about 949.43 in.$^3$ to about 1159.53 in.$^3$, such as about 1054.12 in.$^3$, or about 1.748 times a conventional volute scroll.

The volume of volute scroll 502 can also be enlarged by increasing the width of the scroll without enlarging volute scroll throat area 502*a*, or other dimensions can also be increased. The ratio of the volume of volute scroll 502 to the cross-sectional area of the discharge comprises a range of about 35.79 to 73.60.

Tests results indicate that the enlarged volume of volute scroll 502 contributes to overall performance of pump 100 while reducing noise, as is illustrated by Table 1.

Figure 5A:
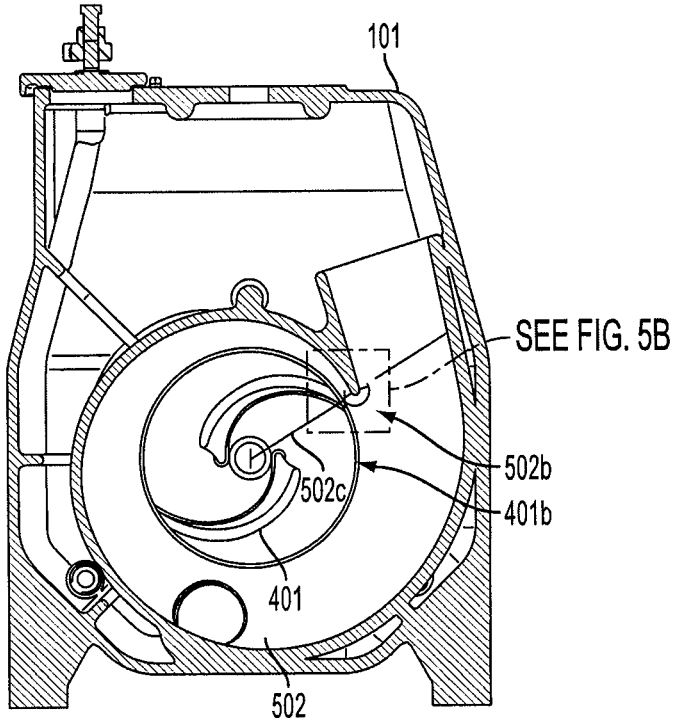
FIG. 5A is a partial cross-sectional view of an embodiment of the present invention.
Figure 5B:
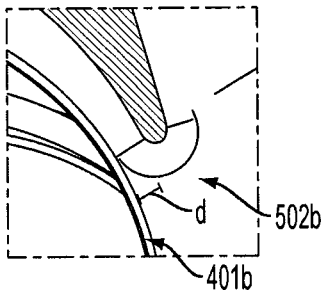
FIG. 5B is an enlarged partial cross-sectional view of an embodiment of the present invention.

FIGS. 5A and 5B illustrate one embodiment of the present invention that includes volute housing 101, volute scroll 502 located within volute housing 101, and cutwater member 502*b* that provides a leading edge for the liquid flowing through pump 100. Cutwater member 502*b* has a diameter that is equal to twice that of cutwater radius 502*c*, measured from the center of impeller 401 to cutwater member 502*b*. This embodiment of the present invention uses an increased distance d between cutwater member 502*b* and outer diameter ("OD") 401*b* of impeller 401 to reduce noise and improve pump efficiency over a conventional self-priming pump.

For example, for a conventional 3" self-priming, centrifugal pump:

9.07 in.(cutwater diameter)/8.75 in.(impeller diameter)=1.04.

In contrast, an inventive 3" pump has the following relevant characteristics and ultimate ratio:

10.06 in.(cutwater diameter)/9.00 in.(impeller diameter)=1.12.

Distance d between cutwater member 502*b* and impeller OD 401*b* includes a range of about "0.48 to about 0.58".

Similarly, for a conventional, self-priming 4" pump:

10.07 in.(cutwater diameter)/9.75 in.(impeller diameter)=1.03.

In contrast, an inventive 4" pump has the following relevant characteristics and ultimate ratio:

11.100 in.(cutwater diameter)/9.750 in.(impeller diameter)=1.140.

Distance d between cutwater member 502*b* and impeller OD 401*b* includes a range of about 0.61" to about 0.74".

For a conventional, self-priming 6" pump:

13.005 in.(cutwater diameter)/12.375 in.(impeller diameter)=1.01.

In contrast, an inventive 6" pump has the following relevant characteristics and ultimate ratio:

14.060 in.(cutwater diameter)/12.375 in.(impeller diameter)=1.14.

Distance d between cutwater member 502*b* and impeller OD 401*b* includes a range of about 0.76" to about 0.93".

The ratio of cutwater diameter to impeller OD includes a range of about 1.01 to about 1.25.

Resulting improvements in the self-priming capability of pump 100 are demonstrated by the tests results shown in Table 2, below.

TABLE 2

| Suction hopper (in.$^3$) | Speed (rpm) | Lift (ft.) | Time (mins.) |
|---|---|---|---|
| 2276.11 | 1050 | 19 | 4:05 |
| 3503.51 | 1050 | 20 | 4:34 |
| 2276.11 | 1250 | 20 | 3:59 |
| 3503.51 | 1250 | 22 | 4:57 |
| 2276.11 | 1450 | 20 | 4:25 |
| 3503.51 | 1450 | 22 | 4:30 |
| 2276.11 | 1650 | 21 | 1:23 |
| 3503.51 | 1650 | 23 | 1:51 |
| 2276.11 | 1800 | 23 | 5:18 |
| 3503.51 | 1800 | 25 | 4:41 |
| 2276.11 | 2000 | 24 | 1:47 |
| 3503.51 | 2000 | 26 | 2:01 |

Figure 6:
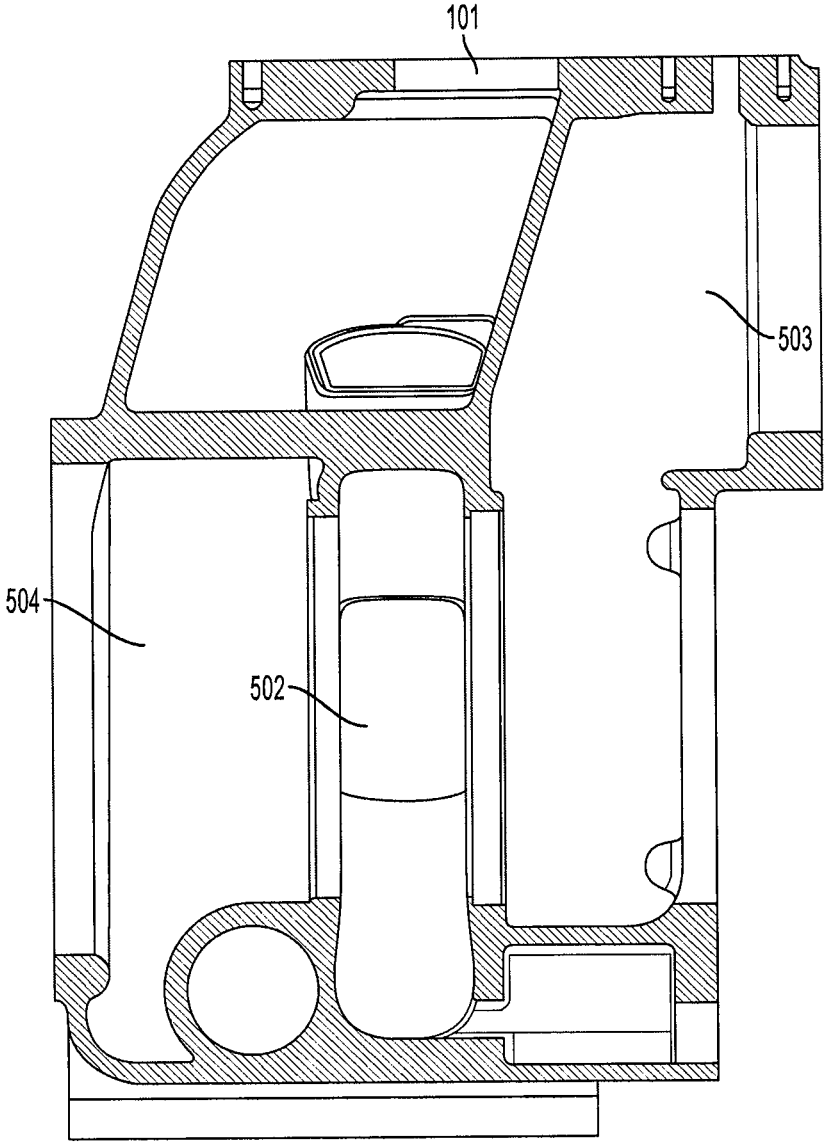
FIG. 6 is a partial cross-sectional view of an embodiment of the present invention.

FIG. 6 is a cut-away side view of one embodiment of the present invention that includes volute housing 101, volute scroll 502, suction hopper 503, and discharge hopper 504. By increasing the size of suction hopper 503, the self-priming capability of pump 100 is enhanced. The result described herein is a ratio of discharge hopper volume to suction hopper volume as follows.

For a conventional 3" self-priming, centrifugal pump:

1842.91 in.$^3$(discharge hopper volume)/729.00 in.$^3$ (suction hopper volume)=2.53.

In contrast, an inventive 3" pump has the following relevant characteristics and ultimate ratio:

2772.48 in.$^3$(discharge hopper volume)/1613.67 in.$^3$ (suction hopper volume)=1.72.

The volume of discharge hopper 504 includes a range of about 2495.23 in.$^3$ to about 3049.73 in.$^3$.

For a conventional 4" self-priming, centrifugal pump:

2631.69 in.$^3$(discharge hopper volume)/1295.99 in.$^3$ (suction hopper volume)=2.03.

In contrast, an inventive 4" pump has the following relevant characteristics and ultimate ratio:

2693.06 in.$^3$(discharge hopper volume)/2021.60 in.$^3$ (suction hopper volume)=1.33

The volume of discharge hopper 504 includes a range of about 2423.75 in.$^3$ to about 2962.37 in.$^3$.

For a conventional 6" self-priming, centrifugal pump:

3194.85 in.$^3$(discharge hopper volume)/2276.11 in.$^3$ (suction hopper volume)=1.40.

In contrast, an inventive 6" pump has the following relevant characteristics and ultimate ratio:

3164.17 in.$^3$(discharge hopper volume)/3503.51 in.$^3$ (suction hopper volume)=0.923.

The volume of discharge hopper 504 includes a range of about 2847.75 in.$^3$ to about 3480.50 in.$^3$.

The ratio of the volume of discharge hopper 504 to the volume of suction hopper 503 includes a range of about 1.89 to 0.84.

For example, for a conventional, self-priming pump at a speed of 1650 rpm having a suction hopper of 2276.11 in.$^3$, the lift is 21 ft. For an inventive pump at the same speed but with a suction hopper of 3503.51 in.$^3$, the lift is 23 ft. Increased lift indicates improved self-priming.

Thus, it can be seen that as the ratio of discharge hopper volume to suction hopper volume decreases, the self-priming function of the inventive pump increases, as seen in Table 2.

Figure 7:
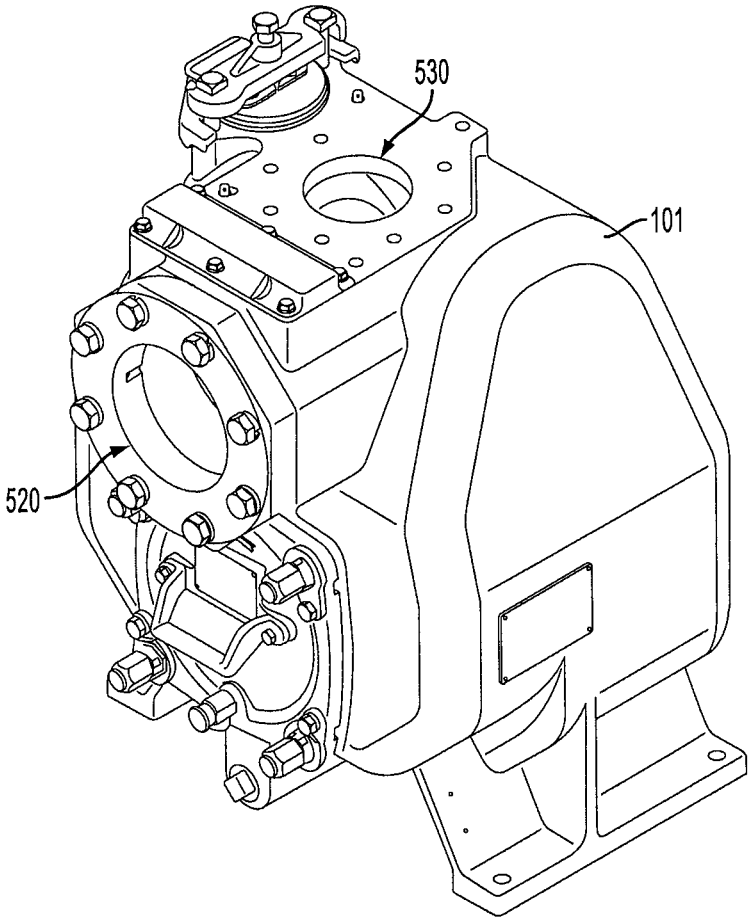
FIG. 7 is an overall perspective view of an embodiment of the present invention.

FIG. 7 illustrates one embodiment of the present invention having volute housing 101, suction 520, and discharge 530. In a conventional self-priming pump, the diameter of suction 520 is typically the same diameter as discharge 530. In the present invention, however, the diameter of suction 520 is one standard pipe size larger than the diameter of discharge 530. For example, pump 100 having discharge 530 of about 3", suction 520 is 4". Similarly, pumps 100 having a discharge of about 4" and 6" have a suction size of about 6" and 8", respectively.

For an inventive 3" pump:

12.57 in.$^2$(4" suction area)/7.07 in.$^2$(3" discharge area) =1.78.

For an inventive 4" pump:

28.27 in.$^2$(6" suction area)/12.57 in.$^2$(4" discharge area)=2.25.

For an inventive 6" pump:

50.27 in.$^2$(8" suction area)/28.27 in.$^2$(6" discharge area)=1.77.

The cross-sectional areas of discharge 530 of an inventive 3", 4", and 6" pump are about 7.07 in.$^2$, 12.57 in.$^2$, and 28.27 in.$^2$, respectively.

The ratio of the cross-sectional area of discharge 530 to the cross-sectional area of suction 520 includes a range of about 1.59 to about 2.48.

Increasing the size of suction 520 increases the NPSHa of the system, increases flow and increases operating range. The larger diameter of suction 520 also helps reduce noise, as shown in Table 1.

Figure 8A:
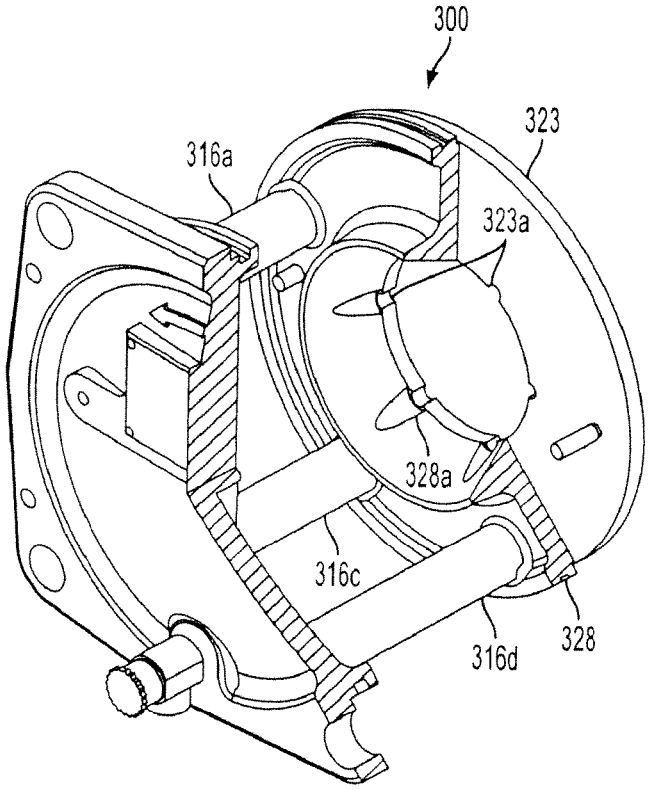
FIG. 8A is a partial perspective view of the wear plate and back cover of an embodiment of the present invention.
Figure 8B:
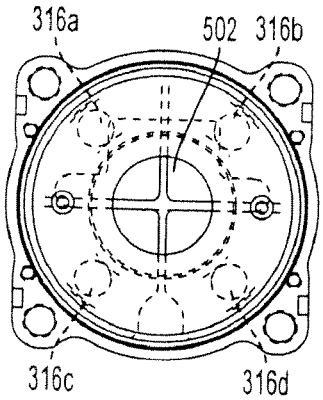
FIG. 8B PRIOR ART
FIG. 8B is a partial side view of the preset invention showing the support posts in the old position.
Figure 8C:
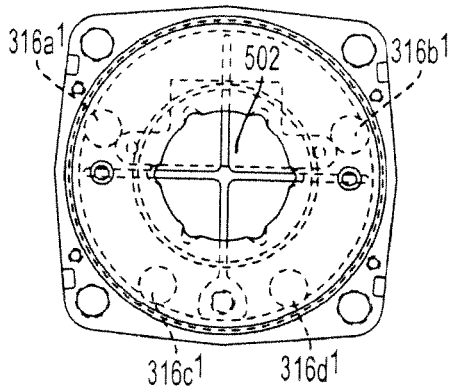
FIG. 8C is a partial side view of the preset invention showing the support posts in the new position.

FIGS. 8A-8C shows an embodiment of the present invention where support posts 316*a-d* are repositioned to assist in the self-cleaning capability of the pump.

In addition to the ability to adjust the length of support posts 316*a-d* previously mentioned above, the location size, or shape may be altered to improve flow characteristics.

For example, back cover and wear plate assembly 300 includes support posts 316*a-d*. Support posts 316*a-d*, shown in FIG. 8*b*, are equally spaced around the circumference of wear plate and back cover assembly 300 in a conventional configuration. In other words, support posts 316*a-d* are approximately located at the two, four, eight and ten o'clock positions, as shown in FIG. 8*b*. However, during normal operation, the location of support posts 316*a-d* partially interferes with the flow of liquid through volute housing 101. In addition, debris contained in the liquid flowing through pump 100 tends to collect on support posts 316*a-d*, ultimately clogging pump 100.

To enhance the self-cleaning capability of pump 100 in this embodiment of the present invention, support posts 316*a-b* are relocated to positions farther apart and farther away from the vertical center line of volute 502, best shown in FIG. 8*c* as 316*a*' and 316*b*'. Similarly, support posts 316*c-d* are relocated to positions closer together and closer to the vertical center line of volute scroll 502, shown as 316*c*' and 316*d*'. Relocated support posts 316*a*'-*d*' clear the flow path through volute housing 101 and resist collecting debris.

In addition to relocating support posts 316*a-d*, the self-cleaning function of pump 100 is improved by adding notches 323*a* and divots 328*a* to wear plate 323 and back cover 328, respectively.

In a conventional arrangement, the wear plate and back cover are smooth, i.e., are free of notches, divots, or other indentations. However, debris contained in the pumped liquid tends to collect on the surface of the inner diameter of the wear plate and back cover. Collected debris builds up as the pump is operated, flow is reduced, and eventually the pump becomes inoperative.

In this embodiment of the present invention, notches 323*a* are added to wear plate 323, as shown in FIG. 8*a*, to break up solids that may be flowing through pump 100 along with liquid. Notches 323*a* can be spaced equally around the circumference of wear plate 323, but the specific number of notches 323*a*, their location, and their shape can vary, according to desired flow characteristics.

Furthermore, divots 328*a* are added to the inner circumference of back cover 328. The location of divots 328*a* corresponds to the location of notches 323*a*. As liquid flows through pump 100, it is channeled through divots 328*a* and assists in removing any solids that may have collected on notches 323*a*. Divots 328*a* are cone-shaped, as shown in FIG. 8*a*, or can have a different geometry according to desired flow characteristics.

The changes made to wear plate and back cover assembly 300 assist in the self-cleaning capability of pump 100 as well as increase performance by resisting clogging and therefore maintaining maximum flow.

In further embodiments, other conventional universal sealing arrangements are provided in place of the removable back cover and wear plate assembly 300.

The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without resorting to the details specifically set forth. In other instances, well known processing structures have not been described in detail, in order not to unnecessarily obscure the present invention.

Only an exemplary embodiment of the present invention and but a few examples of its versatility are shown and described in the present disclosure. It is to be understood that the present invention is capable of use in various other combinations and environments and is capable of changes or modifications within the scope of the inventive concept as expressed herein.

What is claimed is:

1. A self-priming, centrifugal pump, comprising:
a volute housing having a suction and discharge, the suction having a suction hopper connected thereto and the discharge having a discharge hopper connected thereto;
a volute scroll having a cutwater and a volute scroll throat area, the volute scroll being disposed within the volute housing, the cutwater having a diameter;
an impeller disposed within the volute scroll, the impeller having a relative exit area and an outer diameter;
wherein a ratio of the volute scroll throat area to a impeller relative exit area is at least about 0.54;
wherein a ratio of the volute scroll throat area to the cross-sectional area of the discharge is no greater than about 1.34;
wherein a ratio of a volute scroll volume to the cross-sectional area of the discharge is no greater than about 73.60;
wherein a ratio of the diameter of the cutwater to the outer diameter of the impeller is at least about 1.01;
wherein a ratio of a volume of the discharge hopper to a volume of the suction hopper is no greater than about 1.89.

2. The device according to claim 1 further comprising:
a back cover and wear plate assembly, comprising:
a wear plate connected to the back cover, the wear plate having inner and outer circumferences and notches disposed on the inner circumference;
a back cover connected to the wear plate, the back cover having inner and outer circumferences and grooves disposed on the inner circumference, the position of the grooves on the back cover corresponding to the position of the notches on the wear plate;
at least one first support post connecting the back cover and wear plate assembly to the volute housing; and,
at least one second support post connecting the back cover and wear plate assembly to the volute housing;
wherein the impeller has an axis of rotation; and
wherein the first and second support posts are disposed asymmetric about the impeller axis of rotation such that flow through the volute scroll is not impeded.

3. The device according to claim 1 wherein a ratio of the volute scroll throat area to the impeller relative exit area is about 0.54 to about 1.11.

4. The device according to claim 1 wherein a ratio of the volute scroll throat area to the cross sectional area of the discharge is about 1.34 to about 0.75.

5. The device according to claim 1 wherein a ratio of the volume of the volute scroll to the cross-sectional area of the discharge is about 35.79 to 73.60.

6. The device according to claim 1 wherein a ratio of the volume of the discharge hopper to the volume of the suction hopper is about 1.89 to about 0.84.

7. The device according to claim 1 wherein a ratio of the cross-sectional area of the suction to the cross-sectional area of the discharge is at least about 1.59.

8. The device according to claim 7 wherein a ratio of the cross-sectional area of the suction to the cross-sectional area of the discharge is about 1.59 to about 2.48.

9. A self-priming, centrifugal pump, comprising:
a volute housing;
a volute scroll having a volute scroll throat area, the volute scroll being disposed within the volute housing;
an impeller disposed within the volute scroll, having a relative exit area and an outer diameter;
wherein a ratio of the volute scroll throat area to the impeller relative exit area is at least about 0.54.

10. The device according to claim 9 wherein the ratio of the volute scroll throat area to the impeller relative exit area is about 0.54 to about 1.11.

11. A self-priming, centrifugal pump, comprising:
a volute housing having a suction and discharge,
a volute scroll having a volute scroll throat area, the volute scroll being disposed within the volute housing;
wherein a ratio of the volute scroll throat area to a cross-sectional area of the discharge is no greater than about 1.34.

12. The device according to claim 11 wherein a ratio of the volute scroll throat area to the cross-sectional area of the discharge is about 1.34 to about 0.75.

13. A self-priming, centrifugal pump, comprising:
a volute housing having a suction and discharge,
a volute scroll having a volute scroll throat area, the volute scroll being disposed within the volute housing;
wherein a ratio of a volume of the volute scroll to a cross-sectional area of the discharge is no greater than about 73.60.

14. The device according to claim 1 wherein a ratio of the volume of the volute scroll to the cross-sectional area of the discharge is about 73.60 to 35.79.

15. A self-priming, centrifugal pump, comprising:
a volute housing;
a wear plate connected to the back cover, the wear plate having inner and outer circumferences and notches disposed on the inner circumference;
a back cover connected to the wear plate, the back cover having inner and outer circumferences and grooves disposed on the inner circumference, the position of the grooves on the back cover corresponding to the position of the notches on the wear plate;
support posts connecting the volute housing to the back cover and wear plate assembly; and
an impeller having an axis of rotation;
wherein the support posts are disposed asymmetric about the impeller axis of rotation such that flow through the volute is not impeded.

16. A self-priming, centrifugal pump, comprising:
a volute housing having a suction and discharge, a volute scroll having a cutwater member and a volute scroll throat area, the volute scroll being disposed within the volute housing, the cutwater member having a diameter;

an impeller disposed with the volute scroll, the impeller having a relative exit area and an outer diameter;

wherein a ratio of the volute scroll throat area to the impeller relative exit area is about 0.54 to about 1.11;

wherein a ratio of the volute scroll throat area to the cross-sectional area of the discharge is about 1.34 to about 0.75;

wherein a ratio of a volume of the volute scroll to the cross-sectional area of the discharge is about 73.60 to about 35.79; and, wherein a ratio of the diameter of the cutwater member to the outer diameter of the impeller is about 1.01 to about 1.25.

17. A self-priming, centrifugal pump, comprising:

volute housing, suction and discharge, suction hopper, discharge hopper;

wherein a ratio of a volume of the discharge hopper to a volume of the suction hopper is about 1.89 to about 0.84; and, wherein a cross-sectional area of the suction is greater than a cross-sectional area of the discharge.

18. The device according to claim 17 wherein a ratio of the cross-sectional area of the suction to the cross-sectional area of the discharge is at least about 1.59.

19. The device according to claim 17 wherein a ratio of the cross-sectional area of the suction to the cross-sectional area of the discharge is about 1.59 to about 2.48.

* * * * *